US008269585B2

(12) United States Patent
Choi

(10) Patent No.: US 8,269,585 B2
(45) Date of Patent: Sep. 18, 2012

(54) MOVABLE CONTACT ASSEMBLY OF ELECTROMAGNETIC SWITCH

(75) Inventor: Yeon Soon Choi, Gyeongsangbuk-Do (KR)

(73) Assignee: LSIS Co., Ltd., Anyang-si, Gyeonggi-do (KR)

( * ) Notice: Subject to any disclaimer, the term of this patent is extended or adjusted under 35 U.S.C. 154(b) by 0 days.

(21) Appl. No.: 13/272,141

(22) Filed: Oct. 12, 2011

(65) Prior Publication Data

US 2012/0092097 A1 Apr. 19, 2012

(30) Foreign Application Priority Data

Oct. 15, 2010 (KR) ..... 10-2010-010072

(51) Int. Cl.
*H01H 67/02* (2006.01)
*H01H 3/00* (2006.01)

(52) U.S. Cl. ..... 335/126; 335/83; 335/129; 335/131; 335/132; 335/185; 335/196; 335/197

(58) Field of Classification Search ..... 335/78–86, 335/124, 126, 128–132, 151, 154, 179, 185, 335/195–201, 202, 203, 220, 248, 281
See application file for complete search history.

(56) References Cited

U.S. PATENT DOCUMENTS

| | | | | |
|---|---|---|---|---|
| 3,815,060 | A * | 6/1974 | Turnbull | 335/133 |
| 4,513,270 | A * | 4/1985 | Belbel et al. | 335/195 |
| 4,593,260 | A * | 6/1986 | Guero et al. | 335/195 |
| 5,394,128 | A * | 2/1995 | Perreira et al. | 335/126 |
| 5,892,194 | A * | 4/1999 | Uotome et al. | 218/68 |
| 2006/0050466 | A1 * | 3/2006 | Enomoto et al. | 361/160 |
| 2009/0096559 | A1 * | 4/2009 | Yano et al. | 335/187 |
| 2009/0322454 | A1 * | 12/2009 | Tanaka et al. | 335/189 |
| 2009/0322455 | A1 * | 12/2009 | Yoshihara et al. | 335/189 |

FOREIGN PATENT DOCUMENTS

KR 854381 B1 * 9/2008

* cited by examiner

*Primary Examiner* — Mohamad Musleh
(74) *Attorney, Agent, or Firm* — Lee, Hong, Degerman, Kang & Waimey

(57) ABSTRACT

An electromagnetic switch includes: a stationary contact; a movable contact movably provided with respect to the stationary contact; a coil configured to move the movable contact to a side of the stationary contact by means of current conduction; and a shaft provided inside the coil such that the movable contact is provided at an end portion thereof, wherein a snap-fit portion having a pair of hooks disposed to face each other is provided at an end portion of the shaft, and the movable contact is fixed between the end portion of the shaft and the hook.

5 Claims, 4 Drawing Sheets

MOVABLE CONTACT ASSEMBLY OF ELECTROMAGNETIC SWITCH

CROSS-REFERENCE TO RELATED APPLICATIONS

This application claims the benefit of Korean Patent Application No. 10-2010-0100772, filed on Oct. 15, 2010, which is hereby incorporated by reference for all purposes as if fully set forth herein.

BACKGROUND OF THE INVENTION

1. Field of the Invention

The present invention relates to a movable contact assembly employed in an electromagnetic switch.

2. Description of the Related Art

In general, an electromagnetic switch may be provided between a storage battery and a power converting device in an electric vehicle such as a hybrid vehicle, a fuel cell vehicle, a golf cart, and an electric forklift to perform the function of supplying and cutting off power provided from the storage battery to the power converting device.

The electromagnetic switch may include a stationary contact, a movable contact brought into contact with or separated from the stationary contact, and an electronic actuator for driving the movable contact. The electronic actuator in the related art may include a coil, a stationary core, a movable core, a shaft, and a return string. The coil may generate an electromagnetic force when a current is supplied. The stationary core may be fixed and disposed at the center of the coil. The movable core may be disposed to be approached to or separated from the stationary core.

The shaft may be provided in a slidably movable manner with respect to the stationary core through the stationary core. Furthermore, an end portion of the shaft may be combined with the movable core so as to be moved together with the movable core, and the other end portion thereof may be connected to the movable contact. The return spring may exert an elastic force to the movable core in a direction such that the movable core is separated from the stationary core.

According to the related art, the movable contact and the shaft may be connected to each other in the following structure. A through hole into which an end portion of the shaft can be inserted may be formed at the center of the movable contact. The movable contact may be inserted into an end portion of the shaft through the through hole. In this state, a corking member may be combined with a corking groove formed at an end portion of the shaft from the outside of the movable contact using a punch not to allow the movable contact to be released from the shaft.

However, in the foregoing case, in order to assemble the shaft with the movable contact, the corking member may be combined with the corking groove using a punch in a state that the movable contact is inserted into an end portion of the shaft and then the movable contact and the shaft are fixed to each other by a jig. Accordingly, it may have a drawback that the overall assembly process is complicated and inconvenient.

Furthermore, the movable contact may be supported in a movable manner along an axial direction of the shaft in the state of being inserted into an end portion of the shaft, and a push spring may be provided between the shaft and the movable contact. The push spring may exert an elastic force in a direction such that the movable contact is to be approached to the stationary contact, thereby allowing the movable contact to maintain the state of being in contact with the stationary contact under a predetermined or higher pressure.

In this case, subsequent to inserting the push spring to an end portion of the shaft, the movable contact should be fixed by a jig to disallow the movable contact to be released from the end portion of the shaft by an elastic force of the push spring. In this state, the corking member may be combined with the corking groove from the outside of the movable contact using a punch. As a result, it may have a drawback that the assembly process is further complicated.

SUMMARY OF THE INVENTION

A task of the present invention is to solve the foregoing problem, and there is provided an electromagnetic switch capable of enhancing the assembly performance to simplify the process.

In order to accomplish the foregoing task, according to an aspect of the present invention, there is provided an electromagnetic switch including a stationary contact; a movable contact movably provided with respect to the stationary contact; a coil configured to move the movable contact to a side of the stationary contact by means of current conduction; and a shaft provided inside the coil such that the movable contact is provided at an end portion thereof, wherein a snap-fit portion having a pair of hooks disposed to face each other is provided at an end portion of the shaft, and the movable contact is fixed between the end portion of the shaft and the hook.

According to the foregoing aspect of the present invention, the movable contact may be fixed in a snap-fit manner by a hook other than a corking manner in the related art, thereby further facilitating the assembly process.

Here, a distance between the hook and the end portion of the shaft may be set to be greater than a thickness of the movable contact such that the movable contact is fixed in a movable manner within the snap-fit portion, and a push spring disposed between the end portion of the shaft and a rear surface of the movable contact to exert an elastic force in a direction such that the movable contact is to be approached to the stationary contact may be additionally provided.

Furthermore, the push spring may be a helical compressive spring, and a spring support groove for accommodating and supporting part of the helical compressive spring may be formed at an end portion of the shaft.

Furthermore, a head having a pair of rib portions protruded in parallel to each other may be provided at the shaft, and both lateral surfaces of the movable contact may be supported between the pair of the rib portions to prevent rotation using the shaft as a rotational axis.

Furthermore, the snap-fit portion may be made of a different material from that of the head.

Furthermore, the snap-fit portion may be fixed between the pair of rib portions.

According to the present invention, a movable contact assembly may be assembled in a snap-fit manner. Accordingly, a movable contact, or even a push spring if necessary, may be easily and conveniently assembled with respect to a shaft without fixing the movable contact by a jig as well as without using a punch. As a result, the assembly can be easily and conveniently carried out, and the assembly process may be also simplified compared to the existing corking method.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Hereinafter, an electromagnetic switch according to a preferred embodiment of the present invention will be described in detail with reference to the accompanying drawings.

Figure 1:
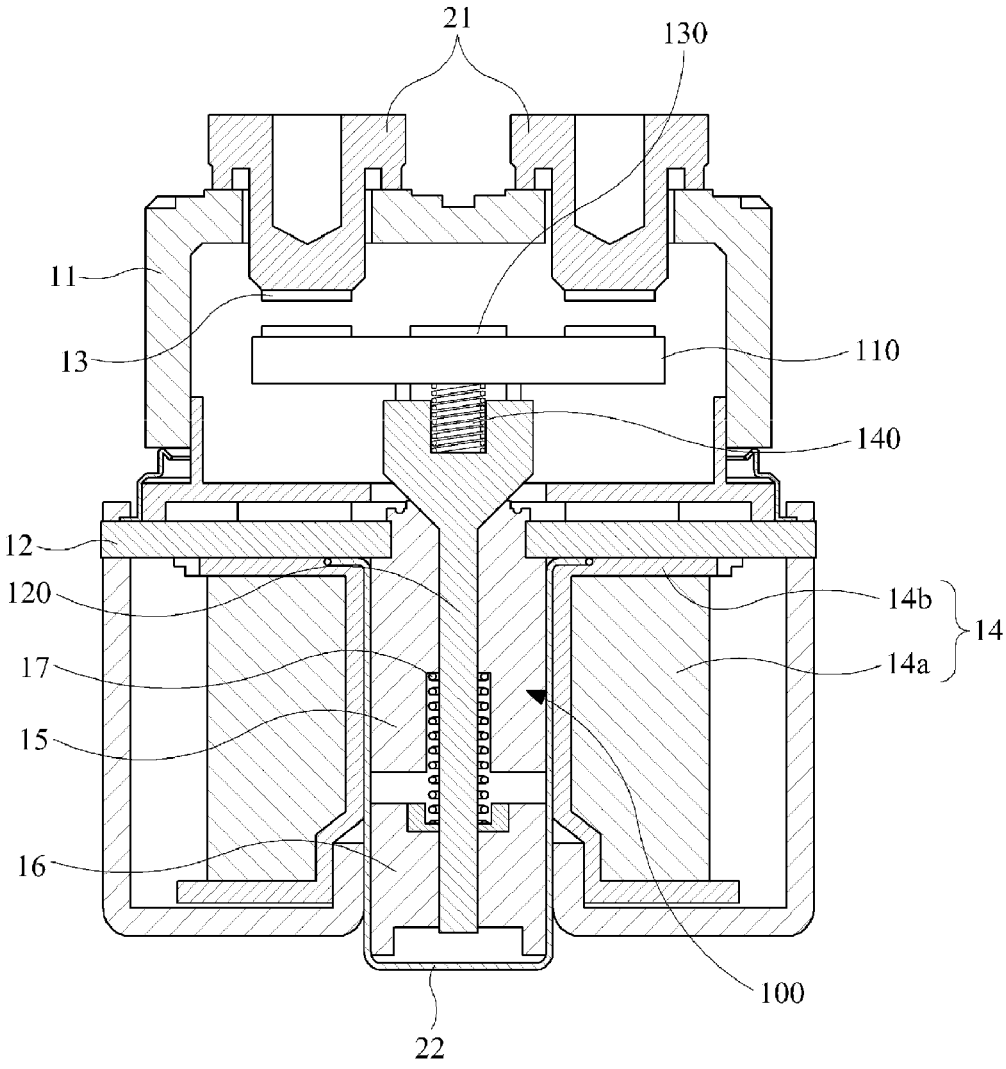
FIG. 1 is a cross-sectional view illustrating an example of an electromagnetic switch to which a movable contact assembly according to an embodiment of the present invention is applied.
Figure 2:
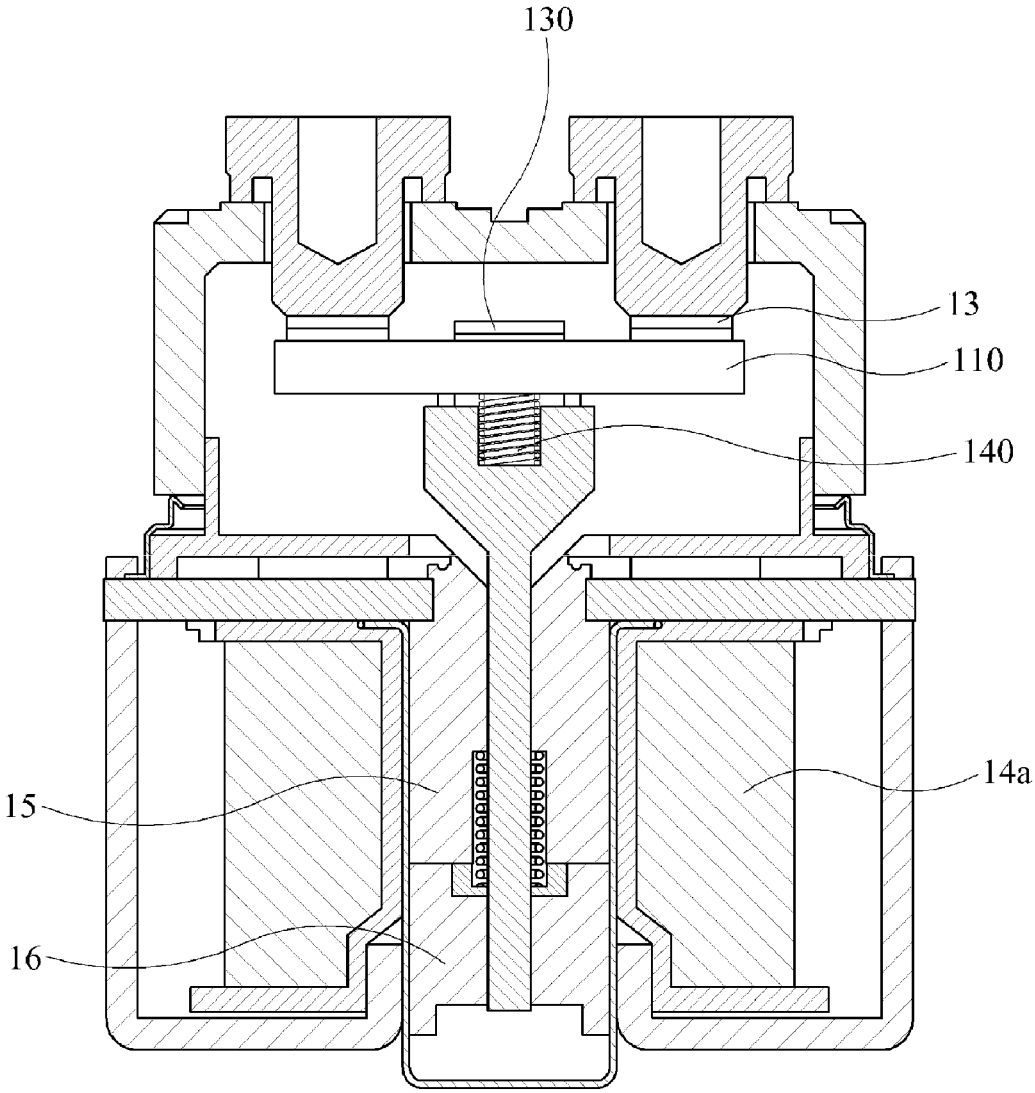
FIG. 2 is a cross-sectional view illustrating a configuration in which a movable contact is moved to be brought into contact with a stationary contact in FIG. 1.
Figure 3:
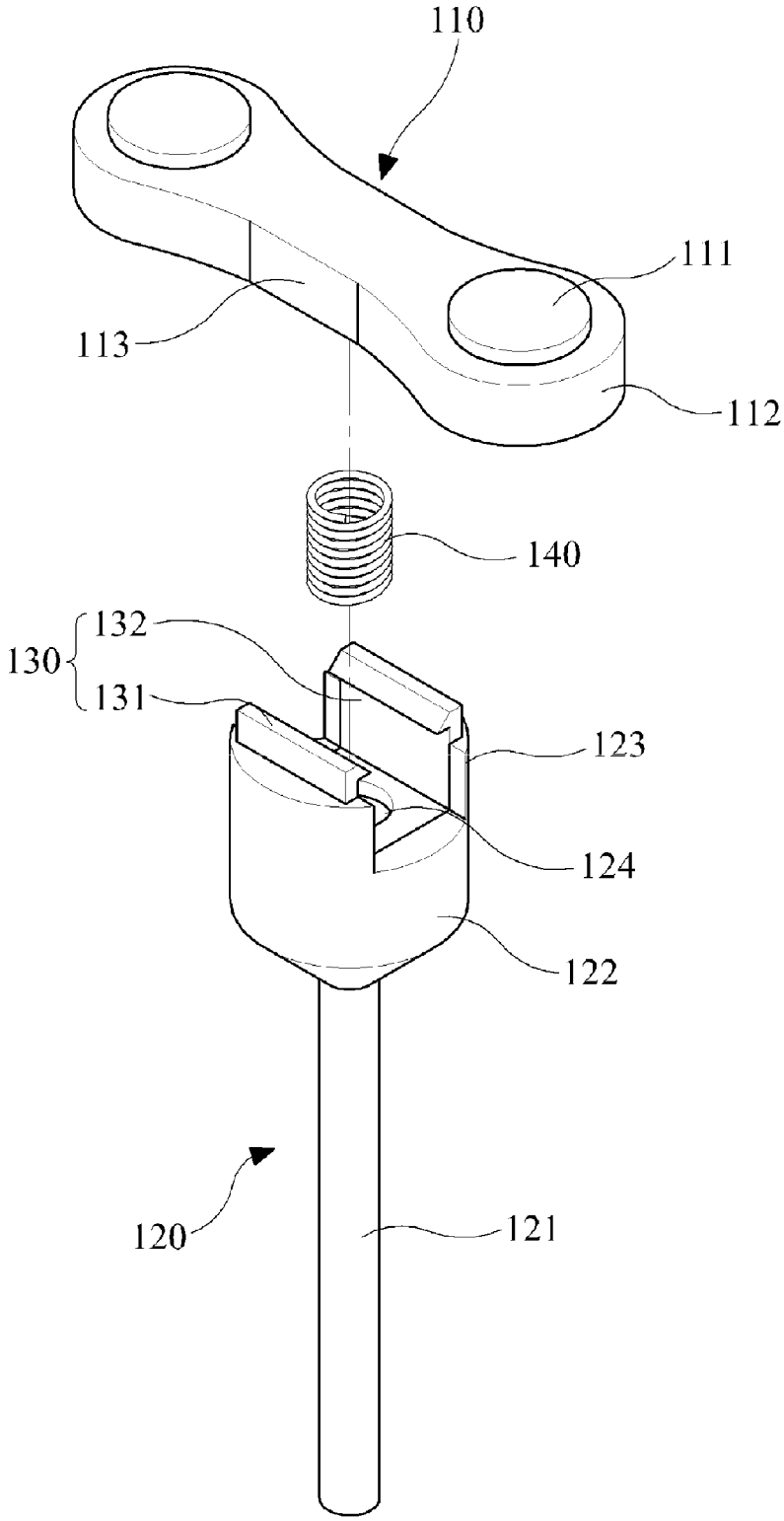
FIG. 3 is an exploded perspective view illustrating a movable contact assembly in FIG. 1.
Figure 4:
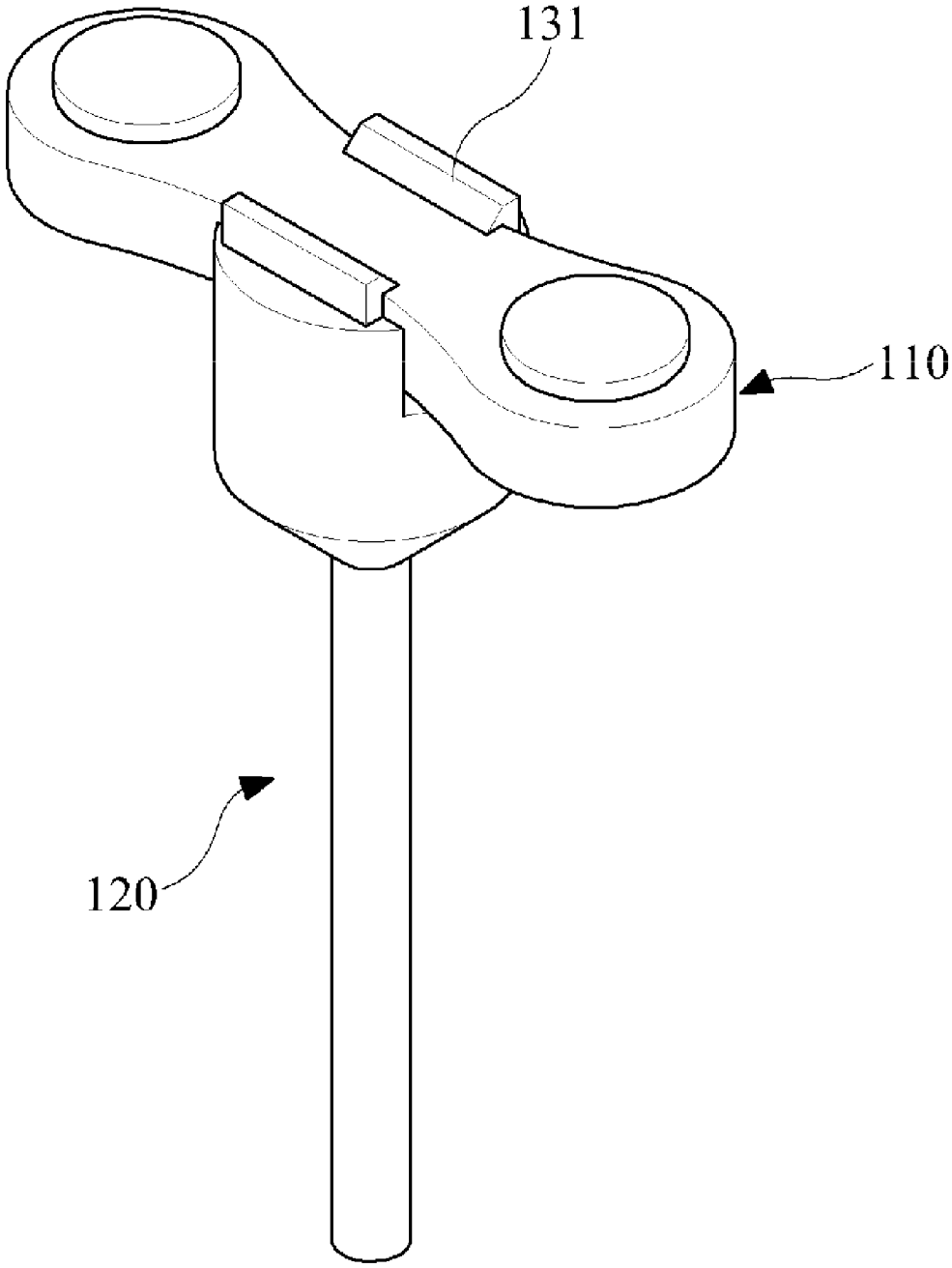
FIG. 4 is a perspective view illustrating a configuration in which the movable contact assembly of FIG. 3 is assembled.

FIG. 1 is a cross-sectional view illustrating an example of an electromagnetic switch to which a movable contact assembly according to an embodiment of the present invention is applied, and FIG. 2 is a cross-sectional view illustrating a configuration in which a movable contact is moved to be brought into contact with a stationary contact in FIG. 1, and FIG. 3 is an exploded perspective view illustrating a movable contact assembly in FIG. 1, and FIG. 4 is a perspective view illustrating a configuration in which the movable contact assembly of FIG. 3 is assembled.

Referring to FIGS. 1 through 4, an electromagnetic switch may include a cover portion 11, a plate 12, a stationary contact 13, a coil assembly 14, a stationary core 15, a movable core 16, and a return spring 17.

The cover portion 11 may be fixed on the plate 12 to form an arc extinguishing space between the plate 12 and itself. The stationary contact 13 may be accommodated into the cover portion 11, and supported by the cover portion 11. A stationary terminal 21 may be connected to the stationary contact 13. The stationary contact may include a plurality of contact terminals.

The coil assembly 14 may be provided on the plate 12, and include a coil 14*a* for generating a magnetic force when a current is supplied. The coil 14*a* may be wound around a bobbin 14*b*. An end portion of the stationary core 15 may be inserted and fixed into the plate 12. The movable core 16 may be operated to be approached to or separated from the stationary core 15 while slidably moving along an inner wall of the cylinder 22.

The return spring 17 may be provided between the movable core 16 and the stationary core 15. The return spring 17 may exert an elastic force to the movable core 16 in a direction such that the movable core 16 is separated from the stationary core 15. Accordingly, when a current supplied to the coil 14*a* is cut off in a state that the movable core 16 has been moved to the stationary core 15 by a magnetic field generated by the current supplied to the coil 14*a* as illustrated in FIG. 2, the movable core 16 may be returned to the original position by an elastic force of the return spring 17 as illustrated in FIG. 1. The return spring 17 may be made of a helical compressive spring.

A movable contact assembly 100 according to an embodiment of the present invention may be moved by a magnetic field of the coil 14*a* to be brought into contact with the stationary contact 13 when a current is supplied to the coil 14*a*, and moved by an elastic force of the return spring 17 to be separated from the stationary contact 13 when a current is cut off from the coil 14*a*. The movable contact assembly 100 may include a movable contact 110, a shaft 120, and a snap-fit portion 130.

The movable contact 110 may be disposed to face the stationary contact 13 and operated to be brought into contact with or separated from the stationary contact 13. In case that the stationary contact 13 has two contact terminals, the movable contact 110 may have the corresponding number of contact terminals 111. The contact terminals 111 of the movable contact 110 may be formed to be separated from each other on the movable contact plate 112.

The shaft 120 may move back and forth through the center of the coil 14*a*, and may include a shaft body 121, a head 122, and a pair of rib portions 123. The shaft body 121 may be formed in a cylindrical shape. An end portion of the shaft body 121 may be combined with the movable core 16. Accordingly, the shaft body 121 may be moved together with the movement of the movable core 16, thereby allowing the movable contact 110 to be brought into contact with or separated from the stationary contact 13.

The head 122 may be formed at an end portion of the shaft body 121. The head 122 may be formed in a shape such that the diameter of the upper surface thereof is greater than that of the shaft body 121. A pair of rib portions 123 may be protruded from both sides of the head 122, respectively, and separated from each other to allow the movable contact 110 to be inserted from the upper portion of the head 122 and support both sides of the movable contact 110. Since the rib portions 123 are separated from each other, the movable contact 110 may be disposed to be placed between the separated rib portions 123.

The snap-fit portion 130 may include a pair of hooks 131. The hooks 131 may be disposed on the rib portions 123, respectively. The hooks 131 may be pushed by the movable contact 110 and deformed to be spaced apart from each other while the movable contact 110 is being inserted between the rib portions 123, and then elastically restored to cross both sides of the movable contact 110 when the movable contact 110 has been inserted between the rib portions 123. As a result, the movable contact 110 may not be released from a space between the rib portions 123 because the movable contact 110 is fastened by the hooks 131 in the state of being inserted between the rib portions 123.

The hooks 131 may be formed of a material having elasticity, for example, plastic and the like. The hooks 131 may be disposed at a position higher than an upper end of the rib portions 123. The snap-fit portion 130 may be formed in a structure that the hooks 131 are connected to each other by a hook connecting portion 132. The hook connecting portions 132 may be combined with each other in a caved-in shape over an inner wall of the rib portions 123 and an upper surface of the head 122. When the snap-fit portion 130 is made of a plastic material and the shaft 120 is made of a metallic material, the snap-fit portion 130 and the shaft 120 may be fabricated with an insert molding process.

Since the movable contact assembly 100 has the foregoing structure, the process of putting the movable contact 110 and the shaft 120 together may be carried out in the following manner. The movable contact 110 may be pushed between the hooks 131 of the snap-fit portion 130 from an upper portion of the head 122. Then, the hooks 131 may be pushed by the movable contact 110 to be spaced apart from each other, and therefore the movable contact 110 may pass through between the hooks 131. Then, the hooks 131 may be elastically restored and moved over an upper surface of the movable contact 110, respectively, to lock both ends of the movable contact 110. Consequently, the process of putting the movable contact 110 into the shaft 120 will be completed.

The assembly process of the movable contact assembly 100 may be carried out in a snap-fit manner as described above. Accordingly, the movable contact 110 may be easily and conveniently assembled with respect to the shaft 120 without fixing the movable contact 110 and the shaft 120 by a jig as well as without using a punch. As a result, the assembly can be easily and conveniently carried out, and the assembly process may be also simplified compared to the existing corking method.

Meanwhile, the rib portions 123 may be formed in such a manner that the movable contact 110 can be moved along an axial direction of the shaft 120. In addition, a push spring 140 may be provided between the head 122 and the movable contact 110. The push spring 140 may exert an elastic force in a direction such that movable contact 110 is to be approached to the stationary contact 13. As a result, when the movable contact 110 is brought into contact with the stationary contact 13, the movable contact 110 can maintain the state of being in contact with the stationary contact 13 under a predetermined or higher pressure. The push spring 140 may be made of a helical compressive spring.

The push spring 140 may be made of a helical compressive spring. In this case, the helical compressive spring may be provided in a compressed state between the head 122 and the movable contact 110. A spring support groove 124 for accommodating and supporting part of the helical compressive spring may be formed on the head 122.

When the push spring 140 is provided in the movable contact assembly 100, referring to FIGS. 3 and 4, the movable contact assembly 100 may be assembled as follows. First, the push spring 140 may be inserted into the spring support groove 124 of the head 122. Subsequently, the movable contact 110 may be pushed between the hooks 131 in the snap-fit portion 130 from an upper portion of the head 122. Then, the hooks 131 may be pushed by the movable contact 110 to be spaced apart from each other, and therefore the movable contact 110 may pass through between the hooks 131.

At this time, the push spring 140 may be pushed by the movable contact 110. If the movable contact 110 has passed between the hooks 131, then the hooks 131 may be elastically restored to move over an upper surface of the movable contact 110, respectively, to lock both sides of the movable contact 110. Consequently, the process of putting the push spring 140 and the movable contact 110 into the shaft 120 will be completed. As described above, the push spring 140 and the movable contact 110 may be easily and conveniently assembled with respect to the shaft 120 without fixing the movable contact 110 by a jig, and therefore the assembly can be easily and conveniently carried out, and the assembly process may be also simplified compared to the existing corking method.

Meanwhile, movement prevention grooves 113 fit into the rib portions 123, respectively, to prevent a horizontal movement of the movable contact 110 may be formed at both sides of the movable contact 110, respectively. The movable contact 110 may be disposed to be placed between the rib portions 123 separated from each other, and thus can be freely moved horizontally. The movement prevention grooves 113 may be fit into the rib portions 123, respectively, to prevent the movable contact 110 from being freely moved horizontally.

What is claimed is:

1. An electromagnetic switch, comprising:

a stationary contact;

a movable contact movably provided with respect to the stationary contact;

a coil configured to move the movable contact to a side of the stationary contact by current conduction; and a shaft provided inside the coil such that the movable contact is provided at an end portion thereof, wherein a snap-fit portion having a pair of hooks disposed to face each other is provided at an end portion of the shaft, and the movable contact is fixed between the end portion of the shaft and the pair of hooks, wherein a distance between the pair of hooks and the end portion of the shaft is greater than a thickness of the movable contact such that the movable contact is movable with respect to the shaft, and wherein the electromagnetic switch further comprises a push spring disposed between the end portion of the shaft and a rear surface of the movable contact to exert an elastic force in a direction to cause the movable contact to move towards the stationary contact.

2. The electromagnetic switch of claim 1, wherein the push spring is a helical compressive spring, and a spring support groove for accommodating and supporting part of the helical compressive spring is formed at the end portion of the shaft.

3. The electromagnetic switch of claim 1, wherein a head having a pair of rib portions protruded in parallel to each other is provided at the shaft, and both lateral surfaces of the movable contact are supported between the pair of the rib portions to prevent rotation using the shaft as a rotational axis.

4. The electromagnetic switch of claim 3, wherein the snap-fit portion is made of a different material from that of the head.

5. The electromagnetic switch of claim 4, wherein the snap-fit portion is located between the pair of rib portions.

* * * * *